United States Patent [19]

Zapolski et al.

[11] 4,247,844

[45] Jan. 27, 1981

[54] ALARM LIGHT

[75] Inventors: Bronislaw Zapolski, Princeton, N.J.; Arthur Eisenkramer, Port Washington; Noel E. Zeller, Mt. Vernon, both of N.Y.

[73] Assignee: Zelco Industries, Inc., Mount Vernon, N.Y.

[21] Appl. No.: 34,125

[22] Filed: Apr. 27, 1979

[51] Int. Cl.[3] ..... G08B 23/00; G08B 7/00; F21V 33/00

[52] U.S. Cl. ..... 340/321; 116/70; 222/39; 340/326; 340/388; 340/404; 362/96

[58] Field of Search ..... 340/321, 326, 385, 388, 340/404–406; 362/154, 157, 186, 96; 222/162, 3, 192, 113, 39; 116/3, 142 R, 70, 106

[56] References Cited

U.S. PATENT DOCUMENTS

| | | | |
|---|---|---|---|
| 2,778,330 | 1/1957 | Jacoby | 116/106 |
| 2,855,497 | 10/1958 | Bacon | 362/96 |
| 2,884,892 | 5/1959 | Swanson | 116/142 R |
| 3,638,836 | 2/1972 | Vickers | 362/96 |
| 3,716,170 | 2/1973 | Mangels | 362/96 |
| 3,776,429 | 12/1973 | De Lucia | 362/96 |

*Primary Examiner*—John W. Caldwell, Sr.
*Assistant Examiner*—James J. Groody
*Attorney, Agent, or Firm*—Bierman & Bierman

[57] ABSTRACT

An alarm light includes a lamp, an alarm, and an actuator moveable for actuating the lamp and alarm. The alarm is powered by pressurized gas for vibrating a chamber-sealing disk to emit a shrieking sound. The actuator is located adjacent to the tank and the bulb and includes a passage leading from the outlet to a disk located in the actuator. The outlet is in communication with the passage and gas is capable of flowing through the outlet, the passage, and an entrance to the chamber containing the disk when the valve is open. The disk is caused to vibrate thereby and emit a piercing sound.

10 Claims, 3 Drawing Figures

ALARM LIGHT

BACKGROUND OF THE INVENTION

The present invention is directed to an improved safety device, particularly one which is capable of summoning help to a threatened person at night.

In the past, various forms of alarms have been known. However, they are usually bulky and difficult and awkward to carry. In addition, they are usually very heavy. These drawbacks are of particular concern to elderly people and women; the very ones who have the most need of such devices.

Therefore, it is among the objects of this invention to provide an alarm light combination which is of novel and unique design.

It is also among the objects of this invention to provide an alarm light which is small and easily carried.

It is still further among the objects of this invention to provide an alarm light which is light in weight and can even be carried in a shirt pocket.

These, and other objects of this invention, will become apparent from the description herein.

SUMMARY OF THE INVENTION

In practicing the present invention, there is provided a lighting means, an alarm means, and an actuator therefor. These basic elements are preferably located within a conveniently shaped carrying case. Of course, at least portions of the elements (especially the light bulb) can be permitted to extend outside of the case.

The lighting means comprises a light bulb, preferably incandescent, in electrical contact with at least one battery. Normally, two batteries in series are preferred.

The alarm means is made up of a tank containing pressurized gas. There is an outlet on the tank and a valve associated with the tank and the outlet which is actuated by movement of the latter. The actuating movement can be in any convenient direction, but is preferably axial. Such valves are well-known in the art and need not be further described.

The actuator is located adjacent both the tank outlet and the bulb. It includes a passage leading from the outlet to a disk which is located within the actuator itself. The outlet communicates with the passage, whereby gas can flow through the outlet and the passage into a chamber closed by the disk. The gas pressure builds up in the chamber and, when it is high enough, the disk flexes, thereby releasing the gas. The pressure in the chamber is reduced, and the diaphragm returns to the closed position. This cycle is repeated several thousand times per second, causing the desired piercing vibration.

The light bulb is controlled by a switch which comprises a conductor in electrical contact with one battery terminal. It extends to a contact point adjacent the bulb. The point is biased away from the bulb and adapted to be urged into contact therewith by the actuator. When this is done, the circuit is completed and the bulb lights.

The actuator is movable between a first position, a second position, and a neutral position. It is provided with a a knob adjacent the contact point and adapted to bring the point into contact with the bulb when the actuator is in the first position. When the actuator is in the second position, it causes movement of the outlet and, hence, the opening of the valve. As a result, movements of the actuator control both the bulb and the alarm.

When the actuator is in the neutral position, neither the bulb nor the alarm is activated.

As a modification of the device, the actuator is provided with a protrusion adjacent the contact point. This protrusion is so located as to cause the contact point to touch the bulb (and thereby complete the circuit) when the actuator is in the second position. In this manner, a threatened person can turn on both the light and the alarm at the same time.

In a preferred form of the device, the actuator is biased toward the neutral position. In a more preferred form of the device, a locking means is provided to hold the actuator in the second position. This will enable the user to turn on the alarm and have it remain on even if the device is dropped or thrown. The locking means, for best results, should be releasable so that the alarm can be turned off if the user so desires.

One form of locking means comprises a spring on the actuator and a button on the spring. There is an opening in the case adapted to receive the button and the opening is out of alignment with the button when the actuator is in the first position or the neutral position, but is in alignment with the button when the actuator is in the second position. The spring urges the button into the opening.

Thus, when the actuator is moved to the second (or alarm) position, the button is urged into the hole in the case. This secures the actuator and prevents it from being urged into the neutral position. The alarm will remain on until the user presses the button back into the hole and, while holding the button in, allows the actuator to return to the neutral position or the first position.

Preferably, the first position is remote from the tank, the second position is nearest the tank, and the neutral position is therebetween. Most preferably, the actuator has a face accessible from the outside of the case and corrugations are provided on the face to minimize slippage of the finger when the actuator is being moved between the various positions.

BRIEF DESCRIPTION OF THE DRAWING

In the accompanying drawings, constituting a part hereof, and in which like reference characters indicate like parts.

DESCRIPTION OF THE PREFERRED EMBODIMENT

Figure 1:
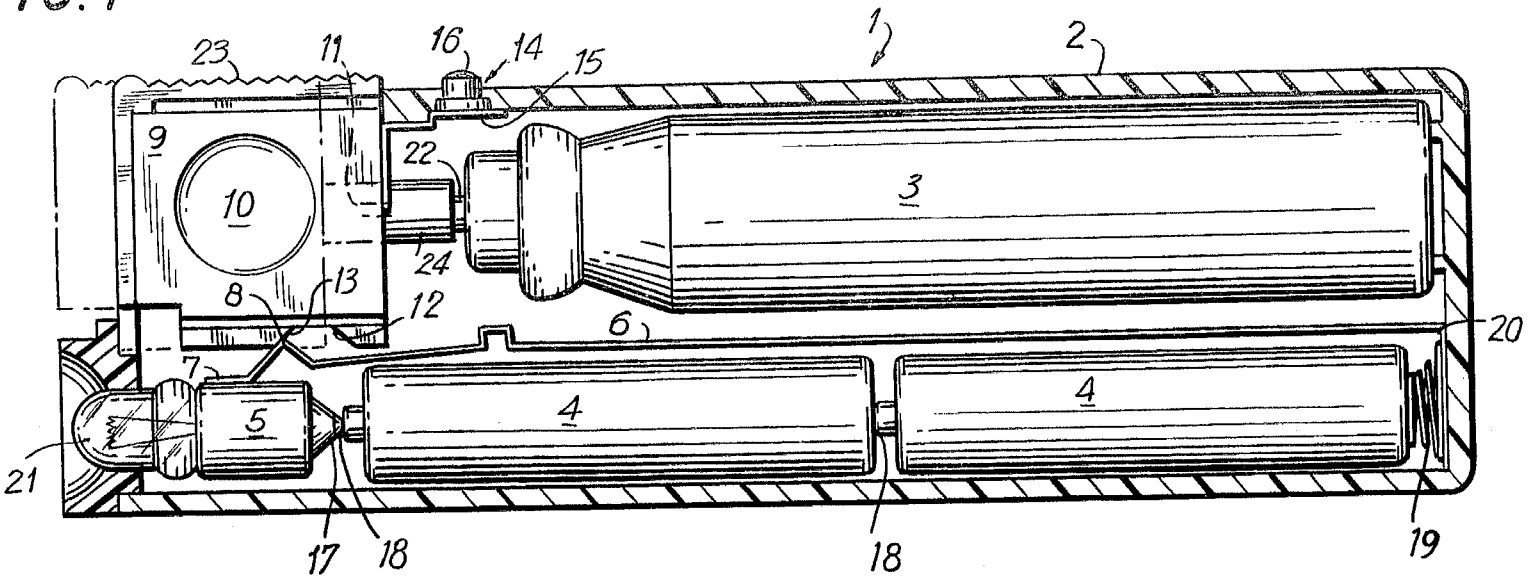
FIG. 1 is a cross-sectional, diagramatic view of the device of the present invention.

The alarm light shown generally at 1 comprises case 2 containing propellant tank 3, batteries 4, bulb 5, and actuator 9. Tank 3 is provided with outlet 22 and a valve (not shown) to control the flow of gas therethrough. The valve is opened by axial movement of outlet 22 toward tank 3. The valve is biased so that release of axial pressure on outlet 22 will cause it to close.

Figure 3:
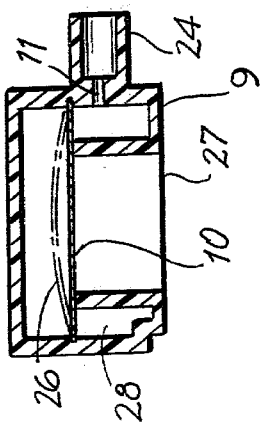
FIG. 3 is a detail of the alarm means in section.
Figure 2:
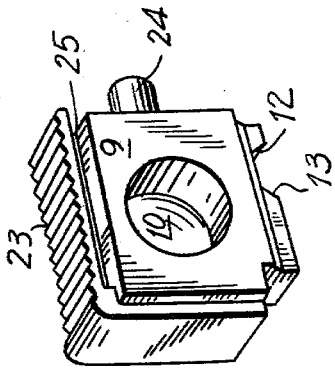
FIG. 2 is a detail of the actuator.

Outlet 22 feeds into passage 11 in actuator 9. Also located in actuator 9 is vibrating disk 10. Passage 11 leads to chamber 28 which is releasably sealed by disk 10. The flow of gas from tank 3 increases the pressure in chamber 28 until disk 10 assumes flexed position 26. This permits the gas to flow out of chamber 28 through exit 27, thereby reducing the pressure therein. Disk 10 then reassumes its sealed position (as shown in full lines in FIG. 3). This cycle takes place thousands of times per second, causing the emission of a piercing sound.

The lighting circuit comprises batteries 4 connected in series. Resilient helix 19 bears against case 2 and against one end of one battery 4 to urge it against the other battery 4 and bulb 5. Battery anode 18 is pressed against bulb nodule 17 insuring good contact. Switch 6 is in electrical contact at connection 20 with the one of batteries 4 remote from bulb 5 and extends to bearing or knob 8 and contact point 7 adjacent actuator 9 and bulb 5 respectively.

When actuator 9 is moved into the first position (shown in dotted lines in FIG. 1), knob 12 on actuator 9 presses against bearing 8 thereby urging contact 7 into electrical contact with bulb 5. This completes the circuit and the bulb lights. In the preferred form of the device, bulb 5 is provided with self-contained lens 21 to focus the beam.

When actuator 9 is moved into the second position, it bears axially on outlet 22, thereby opening the valve between tank 3 and disk 10. The air flows over disk 10 causing it to vibrate and emit a piercing sound.

Protrusion 13 is optionally provided on actuator 9. When actuator 9 is in the second position, protrusion 13 presses against bearing 8 and causes contact 7, to complete the circuit with bulb 5. Thus, when protrusion 13 is provided, movement of actuator 9 into the second position causes the alarm to sound and bulb 5 to light.

Locking means 14 may also be optionally provided. It comprises spring 15 which is affixed to actuator 9. As shown in FIG. 1, actuator 9 is in the second position. Locking means 14 is in its locked position. Spring 15 has urged button 16 through the hole in the case, thus holding actuator 9 in the second position.

To release locking means 14, button 16 is pressed so that it no longer protrudes through the hole. Once this is done, actuator 9 may be moved, by pressure on corrugated face 23 into the neutral or the first position. In going from the neutral, or first, position to the second position, button 16 enters the hole as soon as it gets into alignment therewith. Spring 15 urges it in that direction.

Actuator 9 is preferably provided with groove 25 whereby it is positioned in case 2 for sliding motion. Inlet 24 is mounted on actuator 9 and contains passage 11.

While only a limited number of embodiments of the present invention have been specifically described, it is, nonetheless, to be broadly construed and not to be limited except by the character of the claims appended hereto.

What is claimed is:

1. An alarm light comprising a lighting means, an alarm means, and an actuator therefor, all substantially within a case, said lighting means comprising a light bulb in electrical contact with at least one battery, said alarm means comprising a tank which contains a source of pressurized gas, said tank including an outlet for the gas and a valve actuated by movement of the outlet to open the valve and release the pressurized gas from said tank through its outlet, said actuator being adjacent said tank and said bulb, and comprising a passage in communication with the tank outlet and leading from the outlet to a chamber releasably sealed by a disc in said actuator so that when the valve is open the gas flows through the outlet and said passage and into said chamber causing said disc to vibrate and emit a piercing alarm sound as the gas flows thereover, and a switch for said light bulb comprising a conductor in electrical contact with one terminal of said battery and extending to a contact point adjacent said bulb, said point being normally biased away from said bulb and adapted to be urged into contact therewith for completing an electrical circuit and lighting said bulb, at least a portion of said actuator being moveable between a first position in which said contact point is moved by a knob on said actuator into circuit-completing contact with said bulb, a second position in which the tank outlet is moved by said actuator to open the valve, and a neutral position.

2. An alarm light according to claim 1 wherein neither said bulb nor said alarm is activated when said actuator is in said neutral position.

3. An alarm light accoring to claim 1 wherein said actuator portion is moveable toward and away from said tank.

4. An alarm light according to claim 2 wherein said actuator has a protrusion adjacent said contact point for moving said contact point into circuit-completing contact with said light bulb when said actuator is moved to said second position.

5. An alarm light according to claim 2 wherein said actuator is normally biased toward said neutral position, said alarm light further including locking means for holding said actuator in said second position when moved thereto.

6. An alarm light according to claim 5 wherein said locking means is releasable.

7. An alarm light according to claim 5 wherein said locking means comprises a spring on said actuator, a button on said spring, and an opening in said case adapted to receive said button, said opening being out of alignment with said button when said actuator is in said first and neutral positions and in alignment with said button when said actuator is in said second position wherein said spring urges said button into said opening.

8. An alarm light according to claim 1 wherein said first position is further from said tank than said neutral position and said neutral position is further from said tank than said second position.

9. An alarm light according to claim 1 wherein said actuator has a face accessible from the outside of said case, and said face includes corrugations thereon to facilitate moving said actuator portion between said first, second and neutral positions.

10. An alarm light according to claim 1 wherein said lighting means includes two series-connected batteries.

* * * * *